US008875548B2

(12) United States Patent
Hendrickson

(10) Patent No.: US 8,875,548 B2
(45) Date of Patent: Nov. 4, 2014

(54) LAUNDRY TREATING APPLIANCE WITH CLEANING SYSTEM FOR RESIDUAL TREATING CHEMISTRY

(75) Inventor: Michael S. Hendrickson, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 345 days.

(21) Appl. No.: 12/889,489

(22) Filed: Sep. 24, 2010

(65) Prior Publication Data

US 2012/0073061 A1 Mar. 29, 2012

(51) Int. Cl.
*D06F 39/08* (2006.01)
*D06F 39/02* (2006.01)

(52) U.S. Cl.
CPC ..... *D06F 39/083* (2013.01); *D06F 39/088* (2013.01); *D06F 39/02* (2013.01)
USPC ..... 68/205 R; 68/200; 8/137; 8/158

(58) Field of Classification Search
USPC ..... 8/137; 68/205 R
See application file for complete search history.

(56) References Cited

U.S. PATENT DOCUMENTS

| | | | | |
|---|---|---|---|---|
| 3,736,773 | A | 6/1973 | Waugh | |
| 4,186,573 | A * | 2/1980 | Brenner et al. | 68/12.18 |
| 4,426,362 | A | 1/1984 | Copeland et al. | |
| 5,613,379 | A | 3/1997 | Kim | |
| 6,006,388 | A | 12/1999 | Young | |
| 6,769,627 | B2 * | 8/2004 | Carhuff et al. | 239/120 |
| 2004/0024434 | A1 | 2/2004 | Yang et al. | |
| 2009/0100881 | A1 | 4/2009 | Dahlke | |
| 2009/0293556 | A1 | 12/2009 | Lee et al. | |
| 2009/0308111 | A1 * | 12/2009 | Robb et al. | 68/17 R |
| 2010/0000264 | A1 | 1/2010 | Luckman et al. | |
| 2010/0000578 | A1 | 1/2010 | Hendrickson et al. | |
| 2010/0186461 | A1 | 7/2010 | Hasse et al. | |
| 2010/0199724 | A1 | 8/2010 | Schulze | |

FOREIGN PATENT DOCUMENTS

| | | | |
|---|---|---|---|
| DE | 102009030288 | A1 | 1/2010 |
| EP | 0125627 | B1 | 9/1988 |
| EP | 2048275 | A1 | 4/2009 |
| EP | 2171149 | A1 | 4/2010 |
| GB | 2159125 | A | 11/1985 |
| GB | 2288191 | A | 10/1995 |
| WO | 2009/010402 | A1 | 1/2009 |
| WO | 2009/021872 | A1 | 2/2009 |

OTHER PUBLICATIONS

German Search Report for DE102011051797, Feb. 23, 2012.

* cited by examiner

*Primary Examiner* — Harold Pyon
*Assistant Examiner* — Katie L Hammer

(57) ABSTRACT

A method and apparatus for at least partially removing residual treating chemistry on an interface between a removable treating chemistry reservoir and a dispensing system of a laundry treating appliance.

11 Claims, 4 Drawing Sheets

LAUNDRY TREATING APPLIANCE WITH CLEANING SYSTEM FOR RESIDUAL TREATING CHEMISTRY

BACKGROUND OF THE INVENTION

Contemporary appliances, such as clothes washers, dryers or dishwashers, may be provided with a dispensing system for automatically dispensing one or more treating chemistries during one or more cleaning cycles. The dispensing system may comprise a bulk dispensing holding multiple charges of treating chemistries, such as inside a removable cartridge. The treating chemistries may be supplied to the treating chamber via a metering pump, which is capable of controlling and varying the amount and dose frequency of treating chemistry from the cartridge.

SUMMARY OF THE INVENTION

The invention relates to a method and apparatus for operating a laundry treating appliance having a treating chemistry dispensing system including a removable reservoir coupled to an inlet of a dispenser, including spraying directly the inlet with a cleaning fluid, whereby the spraying of the cleaning fluid at least partially removes any residual treating chemistry on the inlet.

DESCRIPTION OF EMBODIMENTS OF THE INVENTION

The invention is generally directed toward solving the problem of residual treating chemistry left in a dispensing system upon the removal of a reservoir, such as a cartridge. The residual chemistry may contaminate subsequent chemistry or interfere with the proper functioning of the dispensing system. The particular approach of the invention is to clean the interface between the reservoir and the dispensing system to remove the residual treating chemistry. One contemplated method is to spray a liquid onto the interface upon the removal of the reservoir to effect a rinsing of the treating chemistry from the interface.

Figure 1:
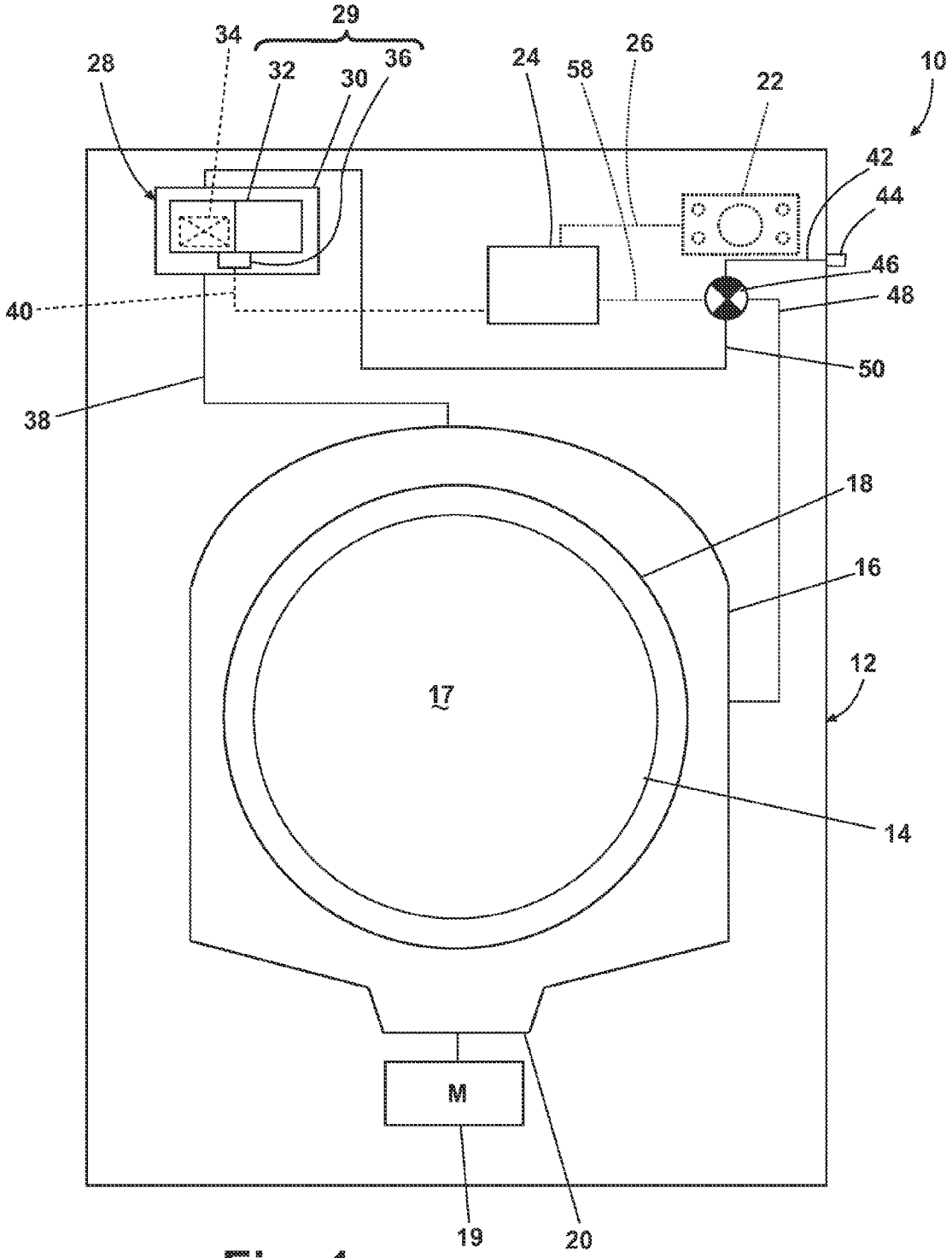
FIG. 1 is a schematic view of a laundry treating appliance in the form of a washing machine according to a first embodiment of the invention.

FIG. 1 is a schematic view of a laundry treating appliance 10 according to a first embodiment of the invention. As illustrated, the laundry treating appliance 10 may be a horizontal axis washing machine, although the laundry treating appliance 10 may be other machines, non-limiting examples of which include a vertical axis washing machine; a clothes dryer; a fabric freshener; a revitalizing machine; a tumbling or stationary refreshing/revitalizing machine; and a non-aqueous laundry system; and a dishwasher. Although much of the remainder of this application will focus on the embodiment of the washing machine, the invention may have utility in other environments, including other cleaning appliances, such as dishwashers, for example. The invention may also be utilized in fabric treatment appliances such as a dryer, such as a tumble dryer or a stationary dryer, or a combination washing machine and dryer.

Vertical axis washing machines have a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis laundry washing machine, the horizontal axis washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. The horizontal axis washing machine 10 shares many features of a conventional automated clothes washer, which will not be described in detail herein except as necessary for a complete understanding of the invention.

Vertical axis and horizontal axis machines are often best differentiated by the manner in which they impart mechanical energy to the fabric articles. In vertical axis machines, the fabric moving element moves within a drum to impart mechanical energy directly to the clothes or indirectly through wash liquid in the drum. In horizontal axis machines, mechanical energy is typically imparted to the clothes by the tumbling action formed by the repeated lifting and dropping of the clothes, which is typically implemented by the rotating drum itself. The invention disclosed herein may be suitable for use in both horizontal axis and vertical axis automatic clothes washing machines. The invention will be illustrated and described, however, in the context of a horizontal axis washing machine.

The washing machine 10 may include a cabinet 12 defining an interior and enclosing components typically found in a conventional washing machine, such as motors, pumps, fluid lines, controls, sensors, transducers, and the like. A door 14 may be hingedly mounted to the cabinet 12 to selectively close an access opening to the interior of a drum 16 that defines a treating chamber 17 in which one or more articles may be treated.

Both the drum 16 and a basket 18 may be located within the interior of the cabinet 12. The drum 16 may be operably coupled with a motor 19 to selectively rotate the drum 16 during a cleaning cycle. The drum 16 may be associated with a sump 20 for holding a liquid used during a cleaning cycle. The sump 20 may be normally connected to a drain via a valve and/or pump to provide a flow path for removing the liquid from the washing machine 10.

The coupling of the motor 19 to the drum 16 may be direct or indirect. A direct coupling may include the output shaft of the motor coupled to a hub of the drum. An indirect coupling may include a belt coupling an output shaft of the motor to a wheel/pulley on the drum.

While the drum 16 may be described as defining the treating chamber 17, with the basket 18 located within the drum 16, it may be that just the basket 18 need be considered the treating chamber 17 as the laundry load is typically retained within the basket 18 and the treating chemistry may be dispensed directly into the basket 18 or indirectly through the drum 16.

The cabinet 12 may also include a dispensing system 28 for dispensing a treating chemistry during a cleaning cycle. The dispensing system 28 may include a reservoir 34 of treating chemistry that is releasably coupled to a dispenser 29, which dispenses the treating chemistry from the reservoir to the treating chamber 17. The treating chemistry may be any type of aid for treating laundry, and non-limiting examples include, but are not limited to washing aids, such as detergents and oxidizers, including bleaches, and additives, such as fabric softeners, sanitizers, de-wrinklers, and chemicals for imparting desired properties to the laundry, including stain resistance, fragrance (e.g., perfumes), insect repellency, and UV protection.

As illustrated, the dispensing system 28 may be located in the upper portion of the cabinet 12 such that the user may access the dispensing system 28 from the exterior of the cabinet 12, although other locations are also possible. The dispenser 29 may include a dispensing housing 30 and a dispensing drawer 32 received within and fluidly coupled to the dispensing housing 30. The reservoir is illustrated in the form of a bulk dispensing cartridge 34 and may be releasably received in the dispensing drawer 32.

Although the bulk dispensing cartridge 34 has been illustrated or described as a rectangular box-like container, the bulk dispensing cartridge 34 may be any type of removable container configured to store multiple doses of a treating chemistry. The container may have any shape and size that is receivable within the dispensing. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispensing.

The dispenser 29 may further include a metering pump 36 fluidly coupling the bulk dispensing cartridge 34 to the dispensing housing 30 which in turn fluidly couples to the tub 16 via a dispensing line 38. The metering pump 36 may be a pump having, for example, a mechanical flow meter, a magnetic flow meter, or any other meter suitable for measuring liquid flow, all well known in the treatment appliance art. The metering pump 36 may be operably coupled with the controller 24 through a control lead 40.

The metering pump 36 may dose treating chemistry into the drum 16 one or more times during a single cleaning cycle. Dosing of the treating chemistry does not need to be done all at one time. For example, smaller amounts of treating chemistry, equal to a full single dose, or in other embodiments, a fraction of a full dose, may be dispensed by the metering pump 36 at separate times throughout the cleaning cycle. Further, multiple full doses may be dispensed during the cleaning cycle. As used herein, the term "single dose of treating chemistry", and variations thereof, refers to an amount of treating chemistry sufficient for one cleaning cycle of the washing machine 10 and the term "multiple doses of treating chemistry", and variations thereof, refers to an amount of treating chemistry sufficient for multiple cleaning cycles of the automatic clothes washing machine.

A water supply system typically provides water to the bulk dispensing system 28. The water supply system is illustrated as having a conduit 42 fluidly coupled with a water supply 44, and a valve 46. The water supply 44 may fluidly couple to the drum 16 directly through conduit 42 to valve 46 and then through a dispensing line 48. Alternatively, the water supply 44 may also be coupled to the drum 16 via the dispensing system 28 and the dispensing line 38, where water is supplied to the dispensing system 28 through conduit 42, valve 46, and conduit 50.

While not shown, some clothes washers include a recirculation system for recirculation of liquid from the sump 20 to the laundry in the basket 18. The recirculating spray may be used in combination with rotating the drum to draw the sprayed liquid through the laundry using centrifugal force. Alternatively, or in combination with the recirculation system, the liquid may be raised to a level within the drum 16 where a portion of the basket 18 may be submerged. The rotation of the basket 18 causes the laundry to tumble in the liquid. Either of the recirculation or tumble methods of cleaning may be used with the current invention. The recirculation system may be implemented by providing a recirculation pump having an inlet coupled to the sump 20 and an outlet supplying a spray nozzle directed to the interior of the drum.

The washing machine 10 may also include a controller 24 to communicably couple one or more components to receive an output signal from components and control the operation of the washing machine 10 to implement one or more cycles of operation. A user interface 22 may be provided to enable the user to input commands to the controller 24 and receive information about a specific cleaning cycle from sensors (not shown) in the washing machine 10 or via input by the user through the user interface 22.

Figure 2:
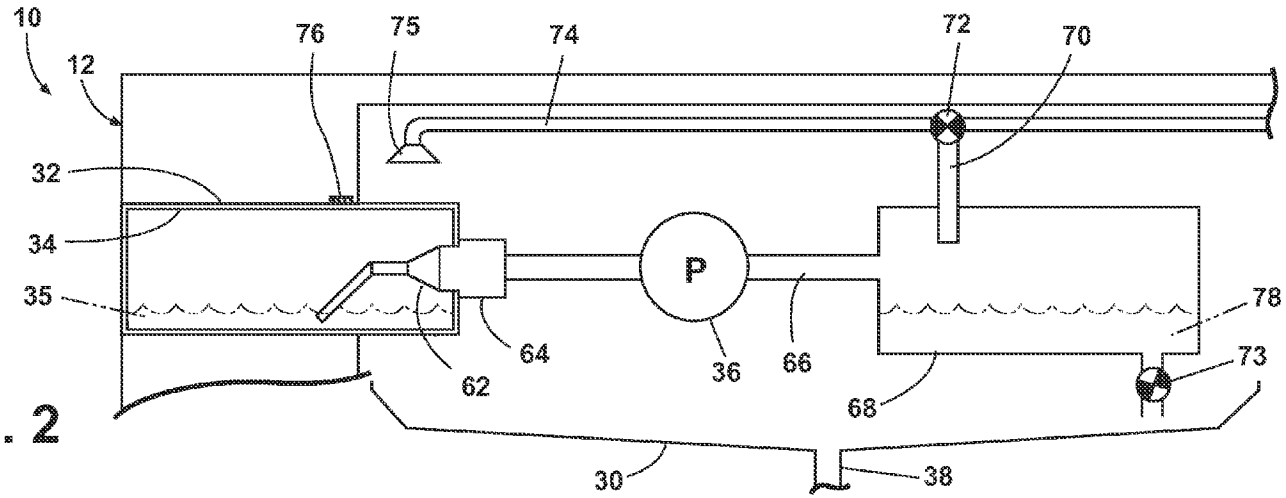
FIG. 2 is a side schematic view of a dispensing system in FIG. 1, with a dispensing drawer having a bulk dispensing cartridge in a closed position.
Figure 3:
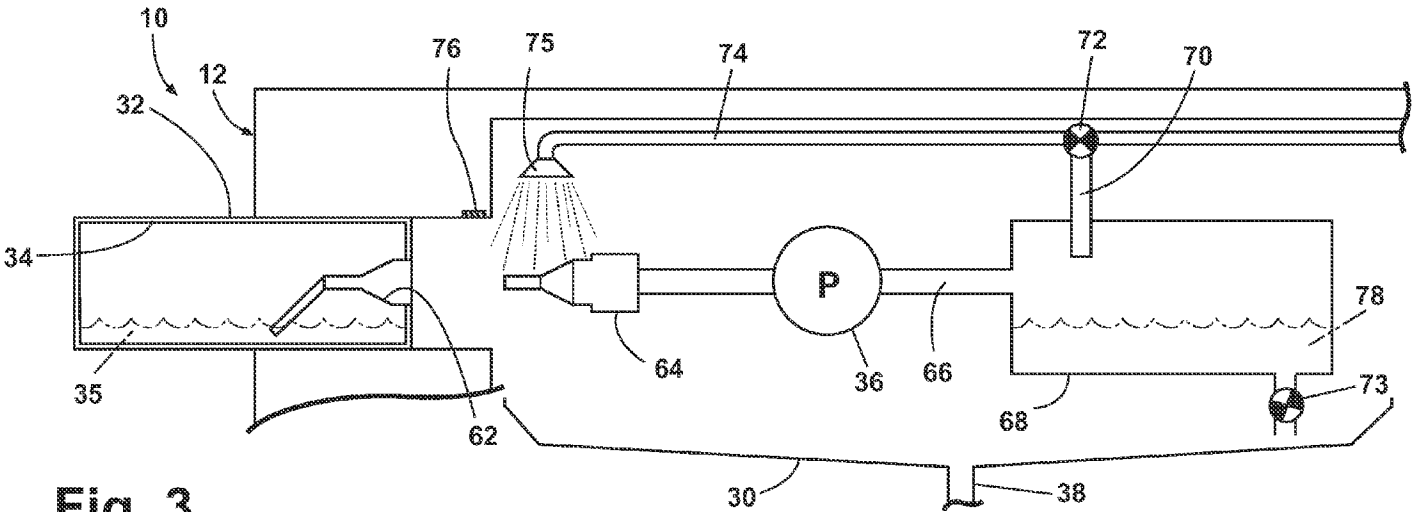
FIG. 3 is a side schematic view of a dispensing system in FIG. 2, with the dispensing drawer in an opened position and a sprayer applying a cleaning spray to an inlet of the dispensing system.

The details of the dispensing system 28 will now be described with respect to FIGS. 2-3. Referring specifically to FIG. 2, the dispenser 29 includes a dispensing drawer 32, which is configured to releasably receive and carry the bulk dispensing cartridge 34. The dispensing drawer 32 is mounted to the cabinet 12 for slidable movement between a closed position (FIG. 2) and an opened position (FIG. 3).

Still referring to FIG. 2, an interface between the bulk dispensing cartridge 34 and the metering pump 36 may be formed by cooperating connectors 62, 64. As illustrated, the bulk dispensing cartridge 34 includes the female connector 62 and the metering pump 36 includes the male connector 64. The male connector 64 defines an inlet for the dispenser 29. The female and male connector 62, 64 may fluidly couple the bulk dispensing cartridge 34 to the metering pump 36. The metering pump 36 may optionally include a valve (not shown) that may be positioned between the male connector 64 and the metering pump 36 to control the flow of the treating chemistry.

Although the female and male connectors 62, 64 are coupled to the metering pump 36 and bulk dispensing cartridge 34 respectively, it is noted that any configuration of male and/or female connectors may be adapted to the metering pump 36 and/or dispensing cartridge 34. For example, female and male connectors may be coupled to the metering pump 36 and bulk dispensing cartridge 34, respectively. In another example, both male connectors may be adapted to fluidly couple the bulk dispensing cartridge 34 to the metering pump 36 by female connectors in between.

The metering pump 36 may be fluidly coupled through an outlet conduit 66 to a mixing chamber 68. The mixing chamber 68 may be further coupled to the water inlet 70 from the water supply 44 through a diverter valve 72. The mixing chamber 68 may be coupled to the treating chamber 17 via the dispensing line 38 and the control valve 73. The mixing chamber 68 is optional and may be eliminated. For example, the water inlet 70 and output conduit 66 may be directly coupled to the dispensing line 38.

The dispensing system may include a cleaning sprayer 74 having at least one nozzle 75 spraying the inlet to the dispenser 29, which is illustrated as the male connector 64. A cleaning fluid from the nozzle 75 may be provided from the water supply 44 through the diverter valve 72. The cleaning sprayer 74 may be located anywhere relative to the male connector 64, but is shown positioned above the male connector 64 of the metering pump 36 such that the nozzle 75 of the cleaning sprayer 74 may directly aim downwardly at the male connector 64, such that the cleaning fluid is caught by the housing 30 and ultimately find its way to the sump 20 where it can be drained.

The dispenser 29 may also comprise one or more sensors 76 for detecting the presence of the cartridge 34 coupled to the dispenser 29. The sensor 76 may be positioned on the inner surface of the cabinet 12, near to the cleaning sprayer 74, while the sensor 76 may be practically positioned anywhere in, or coupled to the dishwasher 10, to sense the displacement or absence of the dispensing drawer 32 relative to the cabinet 12. For example, the sensor 76 may be positioned on the outside portion of the cabinet 10 to sense the movement of the dispensing drawer 32 exterior of the cabinet 12. The sensor 76 may be, for example, in the form of a position sensor, such as a switch, and may be operably coupled to the controller 24.

The sensor 76 may directly or indirectly determine the presence/absence of the bulk dispensing cartridge 34. For example, in the illustrated embodiment, the dispensing drawer 32 being in the opened position is indicative of the bulk dispensing cartridge 34 being uncoupled from the dispenser 29. Thus, the position of the dispensing drawer 32 may be used to indicate the presence/absence of the bulk dispensing cartridge 34. For purposes of this application, determining the presence or absence of the bulk dispensing cartridge 34 are equal alternatives. To the extent only one is described, it should not be considered as excluding the other or limiting the invention to the described version.

Figure 4:
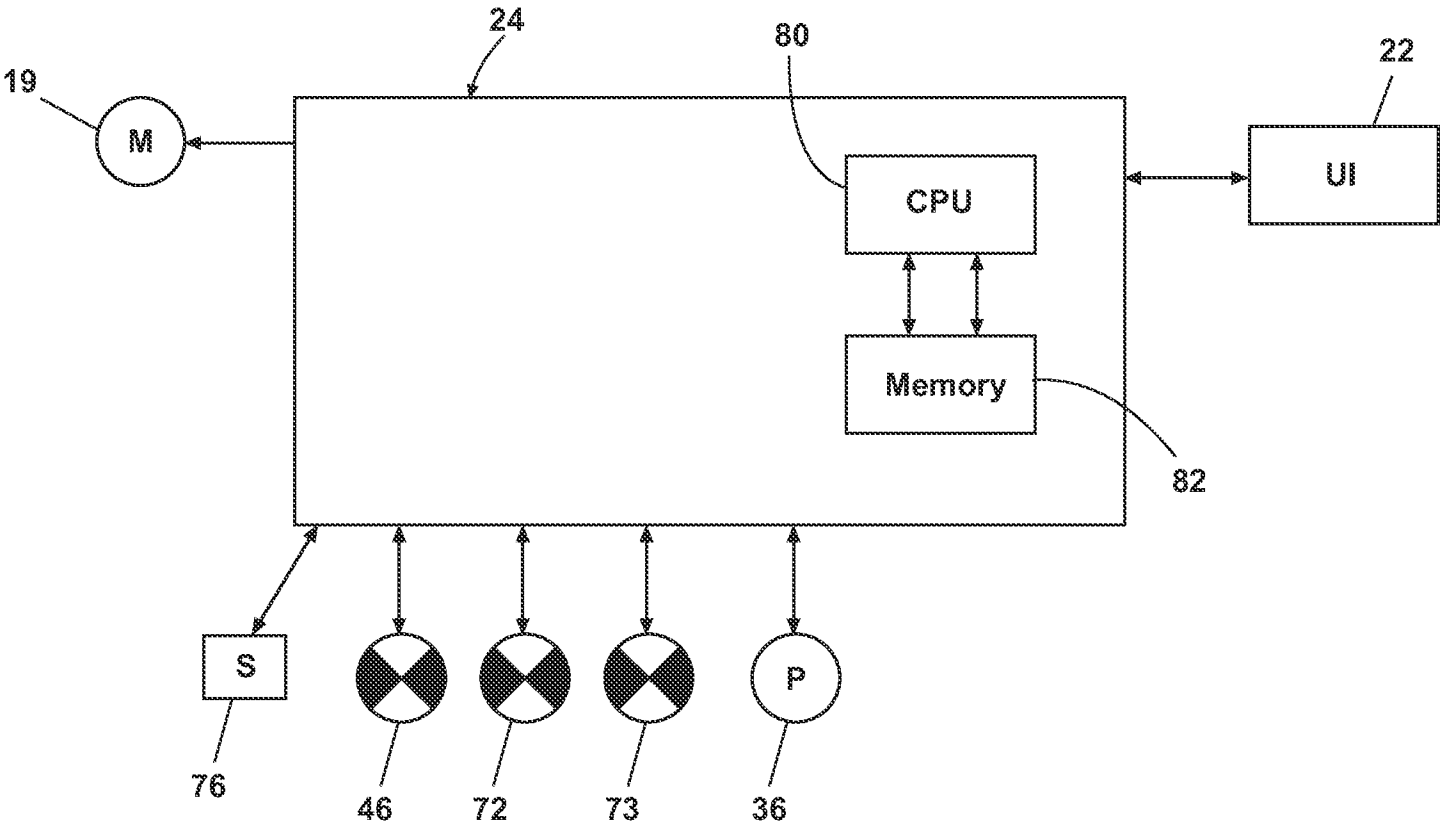
FIG. 4 is a schematic view of a controller of the washing machine in FIG. 1.

FIG. 4 is a schematic view of a controller 24 of the washing machine 10 in FIG. 1. The controller 24 may be communicably coupled to components of the washing machine 10 such as the motor 19, metering pumps 36, control valves 46, 72, 73, and sensor 76 to either control these components and/or receive their input for use in controlling the components. The controller 24 is also operably coupled to the user interface 22 to receive input from the user for the implementation of the wash cycle and provide the user with information regarding the cleaning cycle.

The user interface 22 may be provided that has operational controls such as dials, lights, knobs, levers, buttons, switches, and displays enabling the user to input commands to a controller 24 and receive information about a specific cleaning cycle from sensors (not shown) in the washing machine 10 or via input by the user through the user interface 22. To aid the input of information by the user, the user interface 22 may be electrically coupled with the controller 24 through user interface leads 26. The user may enter many different types of information, including, without limitation, cycle selection and cycle parameters, such as cycle options. Any suitable cycle may be used. Non-limiting examples include, Heavy Duty, Normal, Delicates, Rinse and Spin, Sanitize, and Bio-Film Clean Out. The term "cleaning cycle" is used to mean one operational cycle of the washing machine 10 that cleans a load of laundry.

In this way, the controller 24 can implement a wash cycle selected by the user according to any options selected by the user and provide related information to the user. The controller 24 may also comprise a central processing unit (CPU) 80 and an associated memory 82 where various wash cycle and associated data, such as look-up tables, may be stored. One or more software applications, such as an arrangement of executable commands/instructions may be stored in the memory and executed by the CPU 80 to implement the one or more wash cycles.

In operation, when the dispensing drawer 32 having the bulk dispensing cartridge 34 is in the closed position (FIG. 2), the female connector 64 in the bulk dispensing cartridge 34 engages the male connector 64 for interface coupling. The metering pump 36 may pump a predetermined amount of the treating chemistry 35 from the dispensing cartridge 34 to the mixing chamber 68 one or more times. Water may be separately provided by the actuation of the control valve 46 from the water supply 44 through the diverter valve 72 to the mixing chamber 68. Treating chemistry may be mixed with water in the mixing chamber 68 to form treating chemistry-water solution 78, and supplied to the treating chamber 17 via dispensing line 38.

It is noted that supplying treating chemistry and/or water could be accomplished by the user selecting a cleaning cycle on the user interface 22, which would then be processed by the controller 24, along with an optional determination in a known manner of the size of the load or other load parameters, to automatically dispense the appropriate volume of treating chemistry.

In the closed position, the female and male connectors 62, 64 are coupled, and the dispensing drawer 32 may not move around. Therefore, the sensor 76 does not sense any displacement or absence of the dispensing drawer 32, and does not send any output signal to the controller 24. As a result the cleaning sprayer 74 may not provide any cleaning fluid downward onto the inlet of the first coupler 64.

The dispensing drawer 32 may be withdrawn outside the dishwasher 10 to the opened position (FIG. 3) when, for example, the amount the treating chemistry in the bulk dispensing cartridge 34 is below a predetermined level such that the bulk dispensing cartridge 34 needs to be replaced. When the dispensing drawer 32 slides outside the cabinet 12, the female and male connector 62, 64 may disengage each other, and the residual treating chemistry captured around the exterior of an inlet of the male connector 64 may be exposed.

The position sensor 76 indicating that the drawer is opened may be used as an indication that the inlet of the male connector 64 is exposed, which is accomplished by the position sensor 76 sending an output signal to the controller 24. The controller 24 may then open the diverter valve 72 to provide the cleaning fluid from the nozzle 75 of the cleaning sprayer 74 downward the inlet of the male connector 64 to clean off any residual treating chemistry. The cleaning fluid may include water or mixed treating chemistry-water solution 78. The cleaning fluid may be provided only for a predetermined time. The sprayed cleaning fluid may be received by the dispensing housing, and may drain to the treating chamber 17 or a sump 20 via the dispensing line 38 and the control valve 73.

Figure 5:
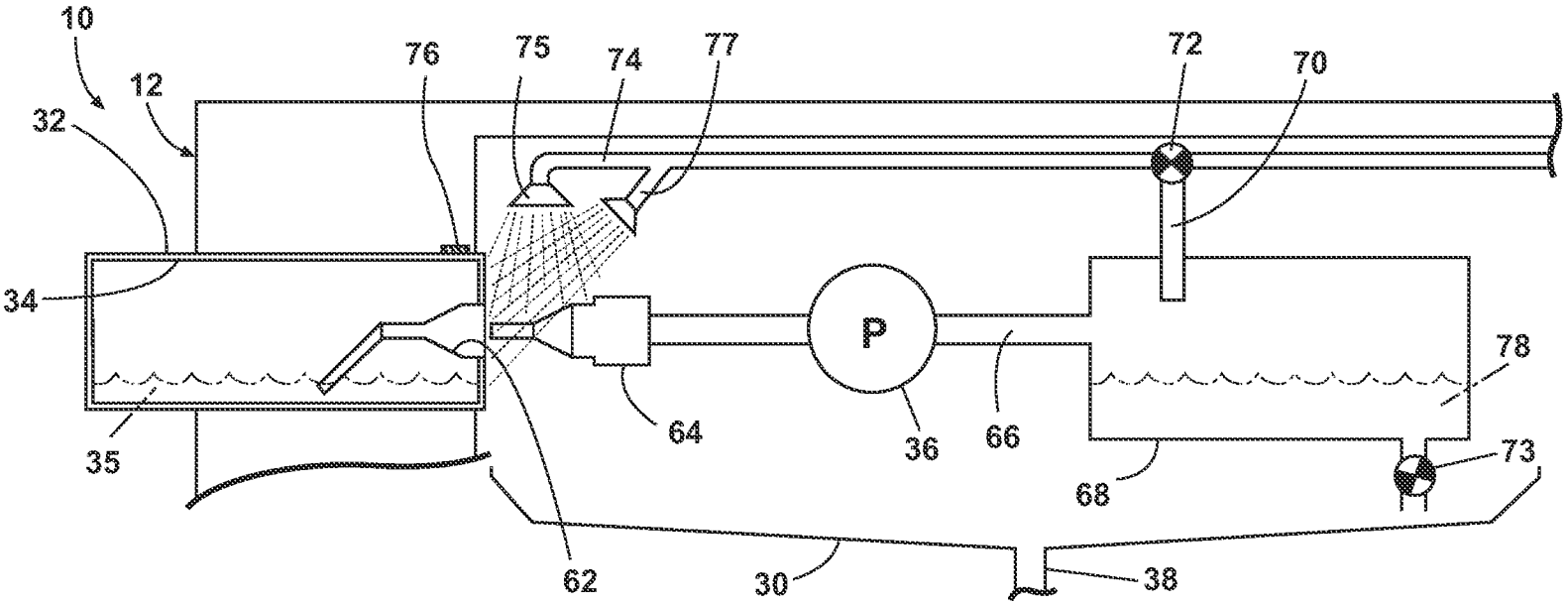
FIG. 5 is a side schematic view of a dispensing system of FIGS. 2 and 3, with the addition of a second cleaning sprayer applying a cleaning spray to a back of a female connector and a dispensing cartridge of the dispensing system, according to a second embodiment of the invention.

FIG. 5 is a side schematic view of variation of the dispensing system of FIGS. 2 and 3, with the addition of a second sprayer 77. This variation of the dispensing system works in the same manner as the dispensing system of FIGS. 2 and 3, except that the second sprayer 77 is configured to spray on the back of the female connector 62 and the cartridge 32 as the drawer is opened. In this manner, the inlet, female connector 62, and cartridge are all sprayed to clean any residual treating chemistry. While two sprayers 74, 77 are illustrated, it is possible to configure just the single sprayer 74 to spray the inlet, drawer, and the cartridge. With this two sprayer configuration, the sensor 76 may be configured to indicate an opened position of the dispensing cartridge 34 when the position of the dispensing cartridge 34 is changed relative to the cabinet 12 by a predetermined spacing, where the predetermined spacing may be such that a liquid of spray may be applied to both the inlet 64 and the dispensing cartridge 34 and the female connector 62 at the same time.

The benefit of a rinsing nozzle with bulk dispensing system may be that the cleaning sprayer 74 is able to clean off any unnecessary, residual treating chemistry that may stick around the inlet of the metering pump 36. Depending on the type of treating chemistry and lapse of time until the bulk dispensing cartridge 34 is replaced, the residual treating chemistry may solidify and interfere with the fluid coupling of the replacement cartridge; and, if the treating chemistries are different, the residual chemistry may contaminate the chemistry in the replacement cartridge. By spraying a cleaning fluid directly onto the connector of the metering pump 36, the possibility that the treating chemistry may block the inlet conduit of the metering pump 36 may be prevented. The spray may also be used to clean the housing 30. The cleaning may be effected without the user having to manually clean off the treating chemistry dropped on the dispensing housing 30 or other component of the washing machine 10.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for operating a laundry treating appliance comprising a treating chemistry dispensing system having a dispenser and a removable cartridge defining a reservoir having a first connector releasably coupled to a second connector on an inlet of a pump for the dispenser, the method comprising directly spraying at least one of the first connector of the removable cartridge for the laundry treating appliance or the second connector of the pump for the laundry treating appliance with a cleaning fluid, wherein the spraying of the cleaning fluid at least partially removes any residual treating chemistry on the at least one of the first or second connectors for the laundry treating appliance and the directly spraying is done when the reservoir is uncoupled from the inlet.

2. The method of claim 1 wherein the uncoupling of the reservoir initiates the spraying of the inlet with the cleaning fluid.

3. The method of claim 1 further comprising spraying at least one of the reservoir or a drawer to remove residual chemistry.

4. The method of claim 1 further comprising draining the sprayed cleaning fluid to at least one of a treating chamber or sump of the laundry treating appliance.

5. The method of claim 1 wherein the treating chemistry comprises water.

6. The method of claim 1 wherein the directly spraying at least one of the first connector of the removable cartridge or the second connector of the pump comprises spraying an exterior of the one of the first connector of the removable cartridge or the second connector of the pump.

7. A method for operating a laundry treating appliance comprising a treating chemistry dispensing system having a dispenser and a removable cartridge defining a reservoir having a first connector releasably coupled to a second connector on an inlet of a pump for the dispenser, the method comprising directly spraying an exterior of at least one of the first connector of the removable cartridge or the second connector of the pump with a cleaning fluid, wherein the spraying of the cleaning fluid at least partially removes any residual treating chemistry on the at least one of the first or second connectors and the directly spraying is done when the reservoir is uncoupled from the inlet.

8. A method for operating a laundry treating appliance comprising a treating chemistry dispensing system having a dispenser and a removable cartridge defining a reservoir having a first connector releasably coupled to a second connector on an inlet of a pump for the dispenser, the method comprising directly spraying at least one of the first or second connectors with a cleaning fluid, wherein the spraying of the cleaning fluid at least partially removes any residual treating chemistry on the at least one of the first or second connectors and the reservoir is carried by a drawer slidably mounted to the laundry treating appliance and a sliding of the drawer uncouples the reservoir from the inlet and the directly spraying is done when the reservoir is uncoupled from the inlet.

9. The method of claim 8 wherein the sliding of the drawer away from the laundry treating appliance uncouples the reservoir from the inlet.

10. The method of claim 9 wherein the sliding of the drawer away from the laundry treating appliance initiates the spraying of the inlet.

11. The method of claim 8 wherein the sliding of the drawer away from the laundry treating appliance initiates the spraying of at least one of the inlet, reservoir, or drawer.

* * * * *